US006935039B1

(12) United States Patent
Hess

(10) Patent No.: US 6,935,039 B1
(45) Date of Patent: Aug. 30, 2005

(54) QUILT SWAG DECORATION TEMPLATE SET AND METHOD

(76) Inventor: Katherine Hess, 747 Spyglass La., Moraga, CA (US) 94556

( * ) Notice: Subject to any disclaimer, the term of this patent is extended or adjusted under 35 U.S.C. 154(b) by 0 days.

(21) Appl. No.: 10/779,060

(22) Filed: Feb. 12, 2004

(51) Int. Cl.[7] ..... G01B 3/14

(52) U.S. Cl. ..... 33/562; 33/565; 33/1 B; 33/12; 33/494

(58) Field of Search ..... 33/562–566, 1 B, 33/1 G, 11–12, 14, 16, 494

(56) References Cited

U.S. PATENT DOCUMENTS

| | | | | | |
|---|---|---|---|---|---|
| 78,325 | A * | 5/1868 | Rand | 33/12 |
| 266,137 | A * | 10/1882 | La Rue | 33/12 |
| 310,666 | A * | 1/1885 | Gates | 33/16 |
| 322,402 | A * | 7/1885 | Tierney | 33/11 |
| 644,756 | A * | 3/1900 | Bailey | 33/562 |
| 2,245,915 | A * | 6/1941 | Hartrampf | 33/1 Q |
| 2,845,712 | A * | 8/1958 | Stimler | 33/1 C |
| 2,986,817 | A * | 6/1961 | Nash | 33/562 |
| 4,211,010 | A * | 7/1980 | Burke et al. | 33/11 |
| 4,502,232 | A * | 3/1985 | Broders | 33/562 |
| 4,524,522 | A * | 6/1985 | Perry | 33/11 |
| 5,094,006 | A * | 3/1992 | Varney | 33/563 |
| 5,749,149 | A * | 5/1998 | Claytor | 33/1 G |
| 5,791,062 | A * | 8/1998 | Walker | 33/563 |
| 5,813,129 | A * | 9/1998 | Tseng | 33/509 |
| 5,881,471 | A * | 3/1999 | Kaluza | 33/563 |
| 5,926,966 | A * | 7/1999 | Russell | 33/562 |
| 5,966,824 | A * | 10/1999 | Vazquez | 33/11 |
| 6,108,918 | A * | 8/2000 | Ye | 33/12 |
| 6,155,189 | A * | 12/2000 | Walner | 33/13 |
| 6,237,240 | B1 * | 5/2001 | Nelson et al. | 33/566 |
| 6,276,070 | B1 * | 8/2001 | Hawley | 33/563 |
| 6,560,887 | B2 * | 5/2003 | Byrnes | 33/534 |

* cited by examiner

*Primary Examiner*—Christopher W. Fulton
*Assistant Examiner*—Yaritza Guadalupe
(74) *Attorney, Agent, or Firm*—Mary Jo Redman; Calif Tervo

(57) ABSTRACT

Quilt swag decoration template set (10) includes adjustable tracing pattern template (15) for creating a shape of predetermined length for marking and cutting out swag pieces (120) and adjustable placement template (45) for marking the location for placing each swag piece (120) to create a swag decoration (119) on border (115) of a quilt (110).

14 Claims, 2 Drawing Sheets

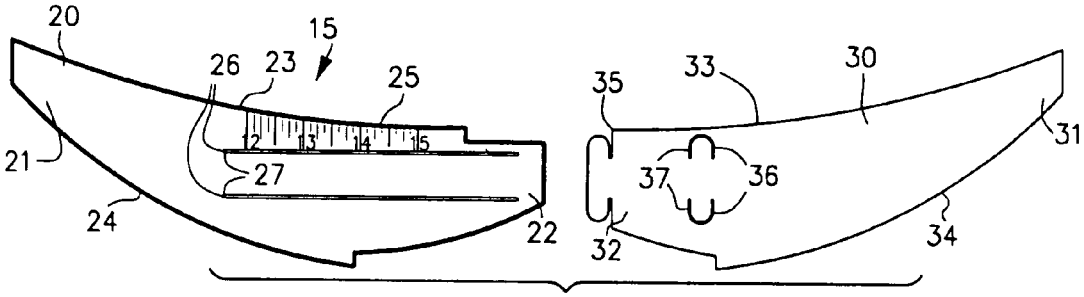
FIG. 2
FIG. 1
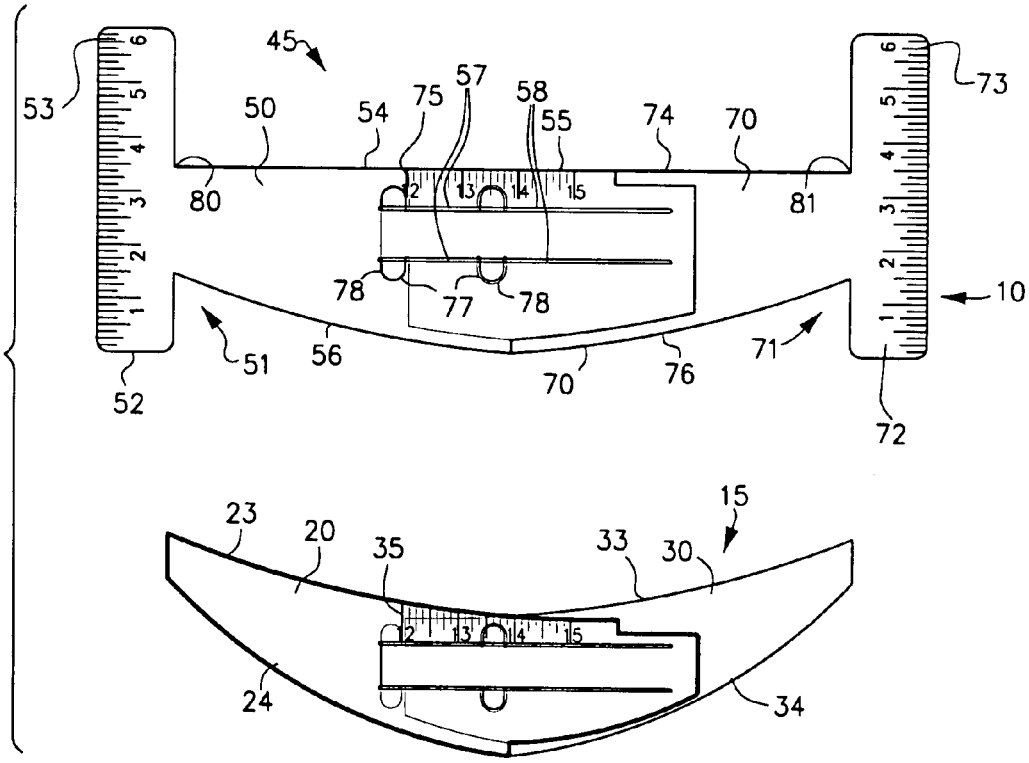

QUILT SWAG DECORATION TEMPLATE SET AND METHOD

FIELD OF THE INVENTION

This invention related in general to tools for making quilts, and more specifically to a set of templates for making and placing pieces for a swag border for a quilt.

BACKGROUND OF THE INVENTION

Fabric quilts are often used as bedspreads, lap throws, or decorative wall hangings. Quilts are made by sandwiching a layer of filling between two layers of fabric and attaching them together by sewing through all three layers with many lines of stitching. A "pieced quilt" is a quilt with a top fabric layer that is made up of several pieces of fabric sewn together before the quilting stitching is sewn.

Often, a pieced quilt includes a central pattern enclosed by a border of large strips of fabric, as seen in FIG. 3. A popular method of embellishing a border is to make a pieced "swag" design consisting of generally crescent-shaped swag pieces arranged end to end and appliquéd onto the border so as to make a scalloped frame.

A border composed of an integral number of complete swag pieces in each side of the frame is more pleasing than a border that includes partial swag pieces on one or more sides.

A traditional method of cutting swag pieces from fabric is to create a crescent-shaped paper template by tracing two curves of different radius. Frequently, the curves are traced from two different circular objects, such as a large dinner plate and a smaller dessert plate. The two ends may be made blunt instead of pointed so that finished swag piece has a neater appearance. This traditional method does not require any special tools other than what can be found in any household, but it can often involve much experimentation to achieve a template of the correct length such that the border contains an integral number of swag pieces. The paper template is then used to mark fabric for cutting the swag pieces.

Handmade quilts, especially quilts intended to be wall hangings, do not always have standard dimensions. Thus, a paper template for cutting swag pieces is not necessarily usable for every quilt. Also, paper templates wear out quickly. For both these reasons, the tedious trial and error of creating a paper template must usually be done each time a swag border is put on a quilt.

Another problem with this traditional method of creating swag designs is positioning each swag piece properly before appliquéing it. Swag pieces are arranged easily if their ends are all aligned along one edge of the border strips. However, it is often preferred for artistic reasons that the swag design be displaced from the edges of the border. In this case, each end of each swag piece must be the same distance from the edges of the border. Unless this distance is measured carefully with a tool such as a T-square, the measurements tend to be imprecise, causing the swag design to waver.

Thus, there has been need for a template tool for creating the outline for a swag decoration piece of the correct length to fit around a quilt border of arbitrary dimensions an integral number of times. There is a need for a template tool that does not require the user to adjust the length by trial and error. Also, there is a need for a template that is re-useable, inexpensive, and sturdy.

Further, there is a need for a tool to aid precise placement of the swag pieces on the border. Also, there is a need for a tool that allows swag pieces to be easily placed without aligning the pieces on an edge of the border. Also, there is a need for a swag placement tool that is re-usable, inexpensive, and sturdy.

SUMMARY OF THE INVENTION

The present invention is a set of two adjustable template tools for creating and placing swag decoration pieces on the border of a quilt. The set includes a tracing pattern template tool for drawing an outline of a swag piece on fabric or paper and a placement template tool for marking a line on the quilt border where each swag piece is to be placed.

Both adjustable template tools are slidably adjustable to any length within a range, for example, a set could create swag pieces of any length from 12 to 15 inches. The required length of swag pieces is calculated by dividing the length of a section of the border by the number of swag pieces desired in that section. The tracing pattern template tool can optionally be used to create an outline for a special swag piece to be placed in each corner of the border.

Once the length for the swag pieces is determined, both template tools are set to that length. Setting the length is done by sliding the ends of a template tool until the length, in inches, is indicated by cooperative indication means, such as a ruler on one piece and an indicator mark on the other piece.

When both template tools are adjusted to the same length, the lower curve of the placement template matches the upper curve of the tracing pattern template.

The tracing pattern template has a generally crescent-shaped outline. The user traces around the tracing pattern template with a pencil or fabric marking tool directly onto the fabric to be cut or onto paper. Many paper patterns may be outlined and cut out, then placed onto the fabric to be cut around. Use of paper patterns avoids marking on the fabric and makes layout for cutting more efficient.

The placement template is used to mark the positions on the quilt border where swag pieces are to be placed. The "drop" that is, the vertical displacement of the swag pieces from the inner edge of the border, is pre-determined or determined by eye while sliding the placement template vertically and the amount of drop, as indicated on the two drop rulers of the placement template, is noted. The lower curve of the placement template is marked as an arc onto the border, then the placement template is moved to the position for the next placement, using the drop rulers to keep the template level so as to have the desired drop.

The swag pieces are placed by pinning or basting each one with its upper curve on an arc marked using the placement template. The swag pieces are sewn in place.

The features and advantages of the invention will be readily understood when the detailed description thereof is read in conjunction with the drawings wherein like reference numerals refer to like parts throughout.

BRIEF DESCRIPTION OF THE DRAWINGS

FIG. 1 is a top view of the Quilt Swag Decoration Template Set of the present invention, including the placement template and the tracing pattern template.

FIG. 2 is an exploded top view of the tracing pattern template of FIG. 1.

DETAILED DESCRIPTION OF THE INVENTION

FIG. 1 is a top view of the Quilt Swag Decoration Template Set 10 of the present invention, including the placement template 45 and the tracing pattern template 15.

FIG. 2 is an exploded top view of tracing pattern template 15 of FIG. 1. Tracing pattern template 15 includes a left piece 20 and a right piece 30.

Figure 3:
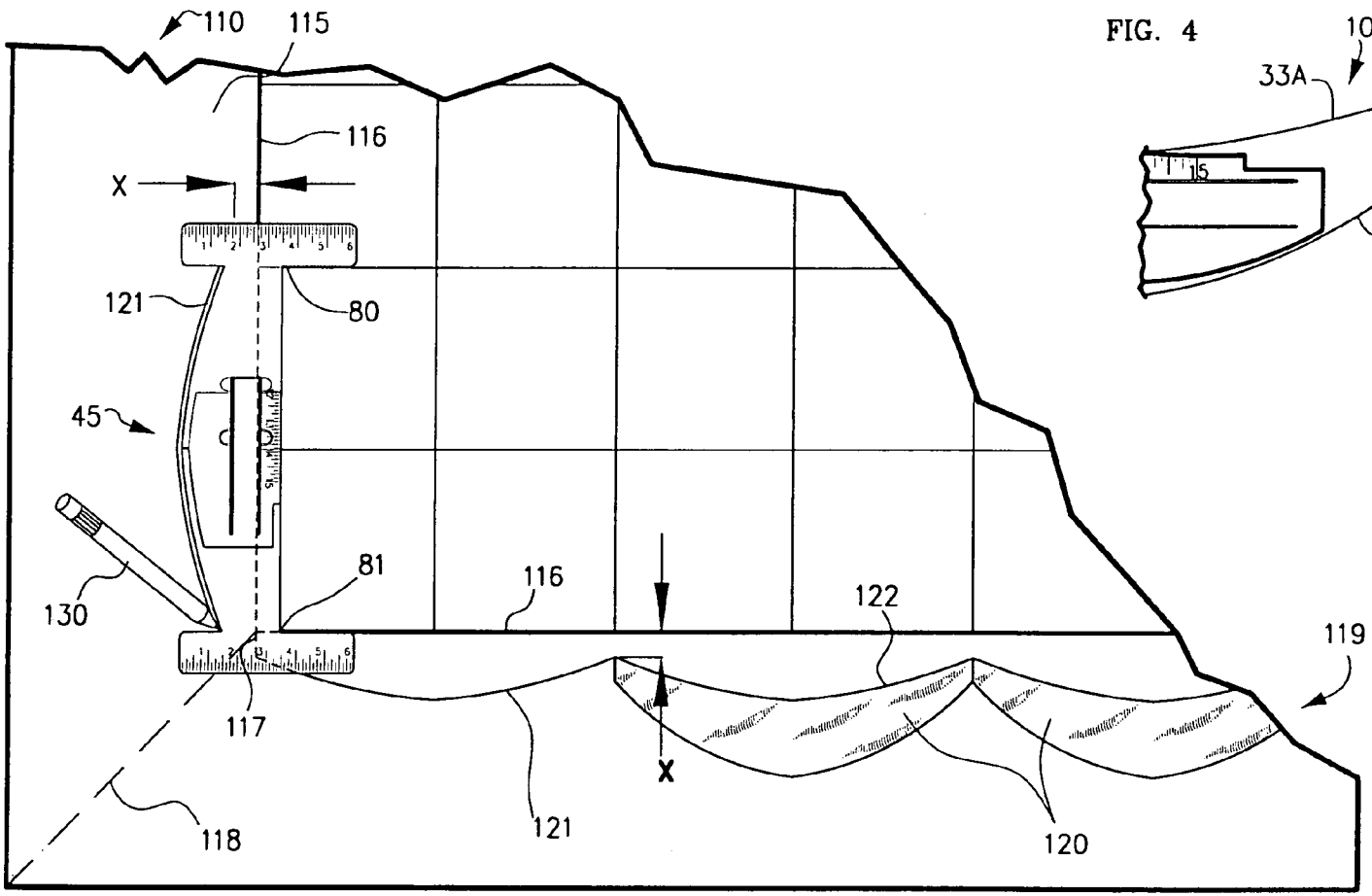
FIG. 3 is a top environmental view of the method of making a swag decoration on a quilt border, using the placement template of FIG. 1.

FIG. 3 is a top environmental view of the method of making a swag decoration 119 comprising a plurality of swag pieces 120 on a border 115 of a quilt 110, using placement template 45 of FIG. 1 to mark the locations where swag pieces 120 are to be sewn. Swag pieces 120 were previously cut from fabric using tracing pattern template 15 to mark the outlines.

It is aesthetically pleasing to create a swag decoration 119 that comprises an integral number of swag pieces 120 and that does not include partial swag pieces 120, even if the quilt border 115 is of non-standard dimensions. To accomplish this, both tracing pattern template 15 and placement template 45 are adjustable in length over a certain range. The required length of swag pieces is calculated by dividing the length of a section of the border by the number of swag pieces desired in that section. A Quilt Swag Decoration Template Set 10 that includes the length in its range is then selected or obtained.

Left piece 20 of tracing pattern template 15 includes tapered end 21, overlap end 22, upper edge 23, lower edge 24, and cooperative slide means 26, such as a pair of slots 27. Right piece 30 includes tapered end 31, overlap end 32, upper edge 33, lower edge 34, and cooperative slide means 36, such as two pairs of tabs 37 adapted to fit within slots 27. Many other cooperative slide means will be apparent to one skilled in the art but are not illustrated.

The preferred embodiment of tracing pattern template 15 shown in the figures has a generally crescent-shaped outline with a length between left tapered end 21 and right tapered end 31 that is adjustable to any length within its range, as determined by cooperative slide means 26, 36, which in the embodiment illustrated is from 12 to 15 inches. Other preferred embodiments have different useful ranges. Other preferred embodiments may have different general outlines that are capable of being varied in length over a range of a few inches.

Left piece 20 includes cooperative length indication means, such as length ruler 25, and right piece 30 includes cooperative length indication means, such as indication feature 35. The length of tracing pattern template 15 is adjusted by sliding tabs 37 along slots 27 until indication feature 35 is aligned with the desired length shown on ruler 25. Because left piece 20 is typically made of transparent plastic, indication means 35 is visible through left piece 20 or by viewing tracing pattern template 15 from above upper edges 23, 33. Many other cooperative indication means will be apparent to one skilled in the art but are not illustrated. In FIG. 1, tracing pattern template 15 is shown as adjusted to a length of 12 inches.

Once adjusted to the desired length, tracing pattern template 15 may be placed directly onto the fabric to be used for making the swag pieces 120, seen in FIG. 3. The outline of tracing pattern template is traced around with a suitable marking tool and the marked fabric cut out.

Alternatively, the tracing pattern template 15 may be placed on paper and traced. Many paper patterns may be marked and cut out. All the paper patterns are then placed onto the fabric and temporarily affixed, as is well known. The patterns may then be cut around to cut out the swag piece from the fabric.

Typically, the fabric piece is cut ¼ inch larger than the paper pattern to form a margin. The margin is turned under with the paper pattern still attached. The margin may be snipped to ease the corners, as is well known in the art of sewing. The paper pattern serves as a folding guide to make it easier to turn the correct amount of margin under. The folded margin may be basted or ironed into place before attaching the fabric piece to the border.

Placement template 45 is shown in FIG. 1 above tracing pattern template 15. Placement template 45 includes a left piece 50 and a right piece 70, which are slidably attached together similarly to tracing pattern template 15.

Placement template left piece 50 includes an outer end 51 including a foot 52, a flat edge 54, curved edge 56, and cooperative slide means 57, such as a pair of slots 58. Right piece 70 includes an outer end 71 including a foot 72, a flat edge 74, curved edge 76, and cooperative slide means 77, such as two pairs of tabs 78 adapted to fit within slots 58.

Left piece 50 includes cooperative length indication means, such as length ruler 55. Right piece 70 includes cooperative length indication means such as indication feature 75. Indication feature 75 is aligned with the desired length indicated on length ruler 55 to adjust the length of curved edges 56, 76 between left foot 52 and right foot 72 to be the desired length of the swag pieces 120 that will be arranged end to end to form swag decoration 119. When placement template 45 is adjusted so as to have the same length as tracing pattern template 15 is adjusted to have, curved edges 56, 76 of placement template 45 combine to form the same curve as the combined upper edges 23, 33 of tracing pattern template 15.

The adjusted placement template 45 is used to mark a curved line onto quilt border 115 to show where the upper edge 122 of a swag piece 120 is to be sewn. The swag decoration 119 shown in FIG. 3 is "floating" in border 115, that is, swag pieces 120 do not have their ends or any other part adjacent to edge 116 of border 115. To mark a consistent displacement "x" of the swag pieces from the inner edge 116 of border 115, the displacement desired, hereafter called the "drop," is measured using left drop ruler 53 and right drop ruler 73 of placement template 45.

The amount of drop desired can be pre-determined, such as from a printed pattern, or chosen by eye, shifting placement template 45 or a cut out swag piece 120 up and down on border 115 until a pleasing drop "x" is found. The distance "x" is then measured using drop rulers 53, 73.

As seen in FIG. 3, placement template 45 has been aligned with corner 117 on inner edge 116 of border 115, to begin marking the locations for swag pieces 120. Both drop rulers 52, 72 are placed so as to indicate identical drops "x", using edge 116 of border 115 as a reference. Placement template 45 is made from transparent plastic to allow edge 116 to be seen through placement template 45. Placement line 121 is marked with any suitable fabric marking tool and the position of left end 80 of flat edge is also marked, such as by a pencil or straight pin.

Placement template 45 is then moved parallel to border 115 such that the right end 81 of right flat edge 74 is positioned at the mark indicating the previous position of left end 80. Drop rulers 52, 72 are positioned relative to edge 116 so as to indicate the correct drop, and another placement line 121 is marked. After placement lines 121 for all swag pieces 120 are marked, swag pieces 120 are put into place by matching each swag upper edge 122 with a placement line 121. Swag pieces 120 are typically basted or pinned in location. Each swag piece 120 is then sewn onto border 115.

As illustrated in FIG. 3, placement lines 121 would result in a line of swag pieces 120 that do not meet along corner diagonal 118 of border 115. To fill this square space centering on corner diagonal 118, a compatible decorative piece may be made by using template set 10. The user cuts a piece of paper the same size as the empty corner of border 115 and folds the paper in half diagonally.

Placement template 45 is used to make a partial placement line 121 on the folded paper, using the same drop as was used for the swag pieces 120. Tracing pattern template 15 is then placed on placement line 121 and a partial outline of tracing pattern template 15 (all that will fit on the paper) is traced onto the folded paper. The outline is cut out through both layers of paper and unfolded. The resulting paper pattern is symmetrical, fits the corner perfectly, and is compatible with swag pieces 120. This pattern is then used to cut out a fabric piece that is sewn into the corner space. The fold in the center of the pattern is placed on corner diagonal 118.

Alternatively, the length of swag pieces 120 may be calculated such that swag pieces 120 sewn end to end to make a frame that is continuously connected around corner diagonals 118. In this case, no corner decoration is needed.

Figure 4:
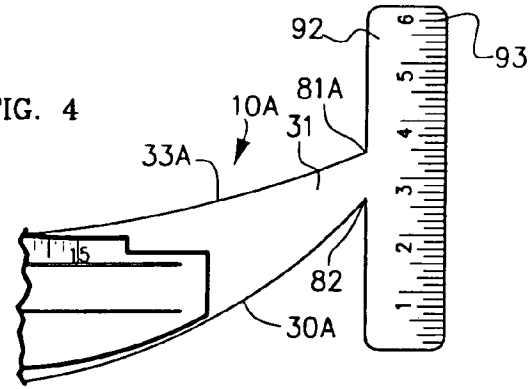
FIG. 4 is a top view, partly cut away, of an alternative preferred embodiment of the template set of the present invention.

FIG. 4 is a top view, partly cut away, of an alternative preferred embodiment of the template set 10 of FIG. 1. Combination template 10A is used both for tracing a pattern for swag pieces 120 and for measuring and marking a line 121 for the placement of swag pieces 120, generally as described above. Combination template 10A includes right piece 30A with taper end 31A, and drop indication means such as foot 92 and drop ruler 93. Left piece 20A, not shown, also includes foot 92 and drop ruler 93 and is substantially a mirror-image of right piece 30A.

To create an outline for a swag piece 120, the length of combination template 10A is set and the outline of combination template 10A is traced around, except for the outline of foot 92. After drawing the outline, combination template 10A is removed from the paper or fabric and a line segment is added connecting upper corner 81A and lower corner 82 to complete the outline.

To mark placement lines 121, the drop "x" is measured using drop rulers 93, as described above. Placement line 121 is marked by tracing right upper edge 33A and left upper edge 23A (not shown) of combination template 10A onto quilt border 115, instead of lower edges 76, 56 of placement template 45.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. An adjustable tracing pattern template device for creating a shape having two edges of different curvature and two ends separated by a desired length; including:

a left piece for creating the left part of the shape; including:

an upper edge having a first curve;

a lower edge having a second curve;

cooperative length indication means for indicating the length of the shape created;

a tapered end; and an overlap end; and a right piece for creating the right part of the shape; said right piece slidably attached to said left piece; including:

an upper edge having a first curve;

a lower edge having a second curve;

cooperative length indication means for indicating the length of the shape created;

a tapered end; and an overlap end; and wherein:

said left piece and said right piece are slidably adjustable such that said left and right tapered ends are separated by an indicated length.

2. The adjustable tracing pattern template device of claim 1, said left piece cooperative length indication means comprising:

a ruler marked legibly upon said left piece; and said right piece cooperative length indication means comprising:

an indication feature.

3. The adjustable tracing pattern template device of claim 1, said left overlap end and said right overlap end each including drop indication means for measuring a drop for placement of the shape created.

4. The adjustable tracing pattern template device of claim 1, said left piece and said right piece each including:

cooperative slide means for slidably adjusting the length of said adjustable tracing pattern template.

5. The adjustable tracing pattern template device of claim 4, said left cooperative slide means comprising:

a pair of slots; and said right cooperative slide means comprising:

two pairs of tabs, each pair adapted to slide within said pair of slots.

6. A quilt swag decoration template set; including:

an adjustable tracing pattern template device for creating an outline for a quilt swag decoration having two edges of different curvature and two ends separated by a desired length;

including:

a left piece for creating the left part of the outline; including:

an upper edge having a first curve;

a lower edge having a second curve;

cooperative length indication means for indicating the length of the outline created;

a tapered end; and an overlap end; and a right piece for creating the right part of the outline; said right piece slidably attached to said left piece; including:

an upper edge having a first curve that is the same as said first curve of said left piece upper edge;

a lower edge having a second curve that is the same as said second curve of said left piece lower edge;

cooperative length indication means for indicating the length of the outline created;

a tapered end; and an overlap end; and wherein:

said left piece and said right piece are slidably adjustable such that said left and right tapered ends are separated by an indicated length; and:

an adjustable placement template device for use for marking the placement location for a quilt swag decoration; including:

a first piece; including:

a ruler end; including:

a drop ruler for measuring the drop of the swag decoration;

an overlap end;

an upper edge; and a curved lower edge; and a second piece slidably attached to said first piece; including:

a ruler end; including:

a drop ruler for measuring the drop of the swag decoration;

an overlap end;

an upper edge; and a curved lower edge; and wherein:

said first piece and said second piece are slidably adjustable such that: said first and second overlap ends overlap; and said curved lower edge is the same length as the swag decoration to be placed; and the shape of said curved lower edge matches the shape of said upper edge of said tracing pattern template device.

7. The quilt swag decoration template set of claim 6; said tracing pattern template left piece cooperative length indication means and said placement template left piece cooperative length indication means each comprising:

a ruler marked legibly upon said left piece; and said tracing pattern template right piece cooperative length indication means and said placement template right piece cooperative length indication means each comprising:

an indication feature.

8. The quilt swag decoration template set of claim 6; said tracing pattern template left piece, said tracing pattern template right piece, said placement template left piece, and said placement template right piece each including:

cooperative slide means for slidably adjusting the length of said adjustable tracing pattern template.

9. The quilt swag decoration template set of claim 8; each left piece cooperative slide means comprising:

a pair of slots; and each right piece cooperative slide means comprising:

two pairs of tabs, each pair adapted to slide within one said pair of slots.

10. A method of decorating an article by attaching to the article an ornamental border of cut-out shapes of variable length by using one or more template tools, including the steps of:

providing a tracing pattern template for creating the outline of the cut-out shapes, the tracing pattern template being adjustable to a desired length within a range of lengths, adjusting the tracing pattern template to the length desired for the cut-out shapes:

tracing around the tracing pattern template with a suitable marking device onto a first suitable material, cutting out the traced outline, providing a placement template that includes two measuring means for measuring the placement location for the cut-out piece relative to a reference feature of the article to be decorated and that is adjustable to the length of the tracing pattern template;

marking the location where the cut-out piece is to be attached to the article by using the placement template and a suitable marking device to mark the location measured by the placement template; and attaching the cut-out piece to the article.

11. The method of decorating an article of claim 10, wherein: the steps of tracing around the tracing pattern template with a suitable marking device onto a first suitable material; cutting out the traced outline; and attaching the cut-out piece to the article are repeated a plurality of times.

12. The method of decorating an article of claim 10, wherein: the step of cutting out the traced outline includes the substeps of:

temporarily affixing the cut-out piece to a second suitable material; and cutting around the cut-out piece to create a second piece of the same shape and of the second suitable material; and wherein the step of attaching the cut-out piece to the article consists of:

attaching the second piece cut out from the second suitable material.

13. The method of claim 12, wherein the substep of cutting around the cut-out piece to create a second piece of the same shape and of the second suitable material comprises:

cutting the second suitable material a predetermined distance from the edge of the cut out piece so as to provide a margin; and further including the substep of:

turning under the margin of the second piece to create a folded edge around the perimeter of the second piece.

14. The method of claim 12, wherein the first suitable material comprises:

paper; and the second suitable material comprises:

fabric.

* * * * *